United States Patent [19]

Spencer

[11] 4,356,749

[45] Nov. 2, 1982

[54] MITER BOX

[76] Inventor: Kieran O. Spencer, 7356 Pottawatomi Dr., Palos Heights, Ill. 60463

[21] Appl. No.: 162,903

[22] Filed: Jun. 25, 1980

[51] Int. Cl.[3] ..... B27G 5/02

[52] U.S. Cl. ..... 83/765; 83/767; 269/303

[58] Field of Search ..... 83/765, 767, 760; 269/303

[56] References Cited

U.S. PATENT DOCUMENTS

| | | | |
|---|---|---|---|
| 105,421 | 7/1870 | Burr | 83/765 |
| 377,299 | 1/1888 | Gardiner | 83/765 |
| 831,940 | 9/1906 | Dorn | 83/765 |
| 845,571 | 2/1907 | Peach | 83/765 |
| 1,465,800 | 8/1923 | Ayres | 83/765 |
| 3,273,612 | 9/1966 | Keddie | 83/767 |
| 3,918,340 | 11/1975 | Wynn | 83/767 |

*Primary Examiner*—Donald R. Schran

*Attorney, Agent, or Firm*—Wegner, McCord, Wood & Dalton

[57] ABSTRACT

A simplified miter box suitable for use with a conventional carpenter's saw comprises upper and lower relatively rotatable platforms with a pair of radially spaced, upstanding saw guide posts fixed to the lower platform. Each post has a vertical, upwardly open saw guide slot extending therethrough. The slots are radially aligned with each other. The upper platform rotates about the first post and has an outer circular edge captured for sliding movement by a complementary groove in the second post. An upstanding workpiece support is fixed to the upper platform, and an angular scale alignable with a reference mark of the lower platform is inscribed on the upper platform outer edge.

10 Claims, 7 Drawing Figures

FIG. 1
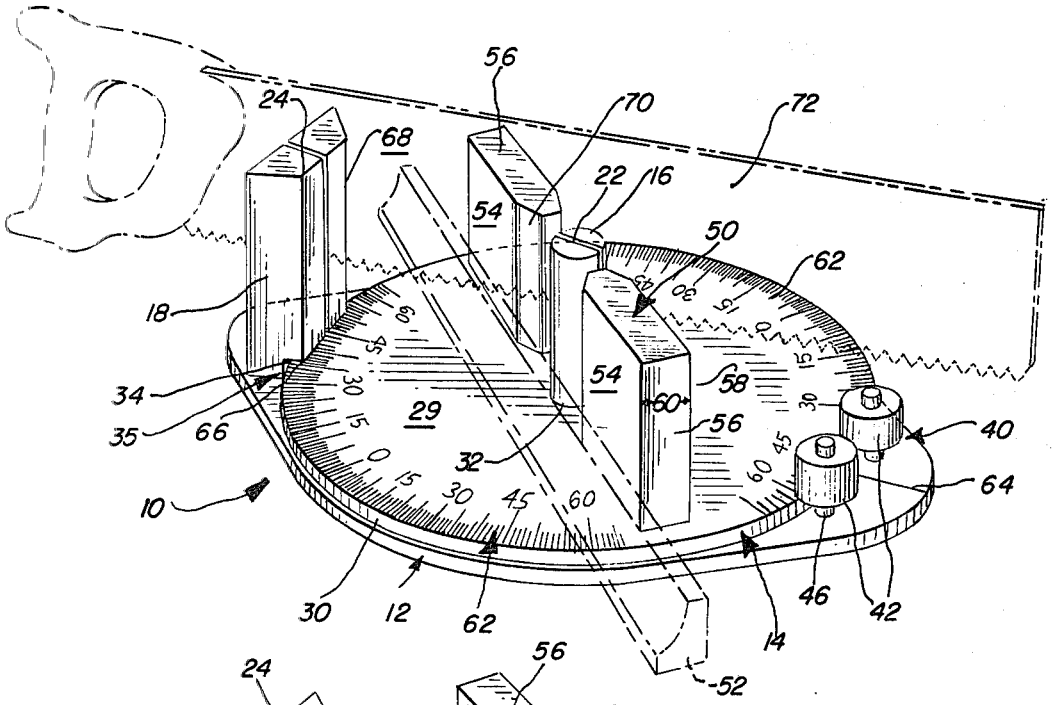
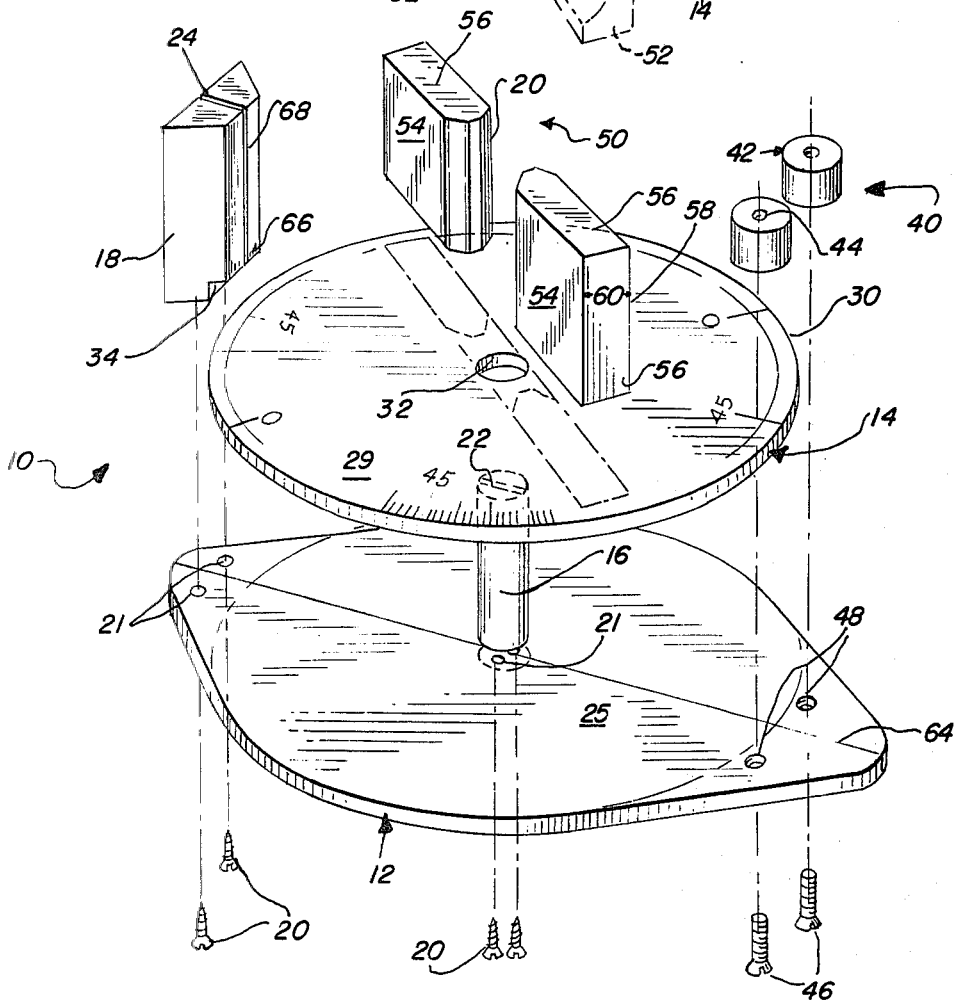
FIG. 2

FIG. 3
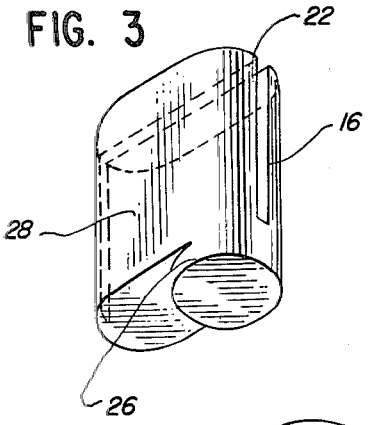
FIG. 4
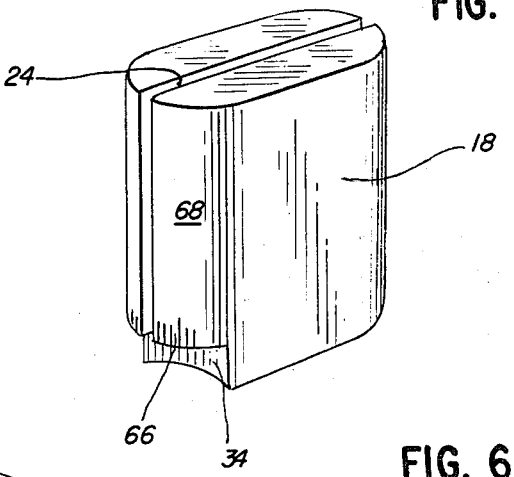
FIG. 5
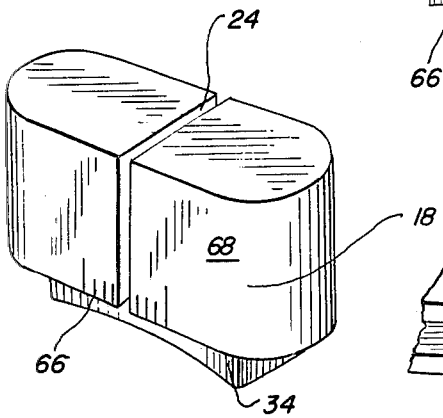
FIG. 6
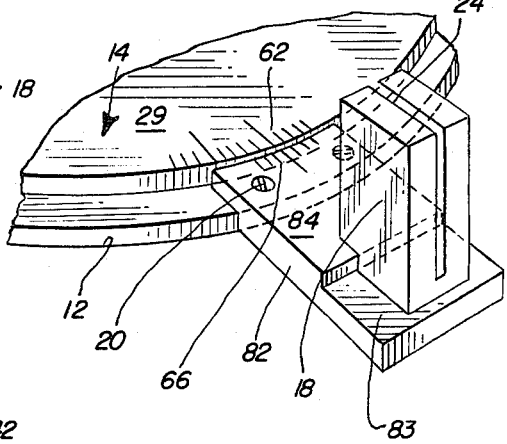
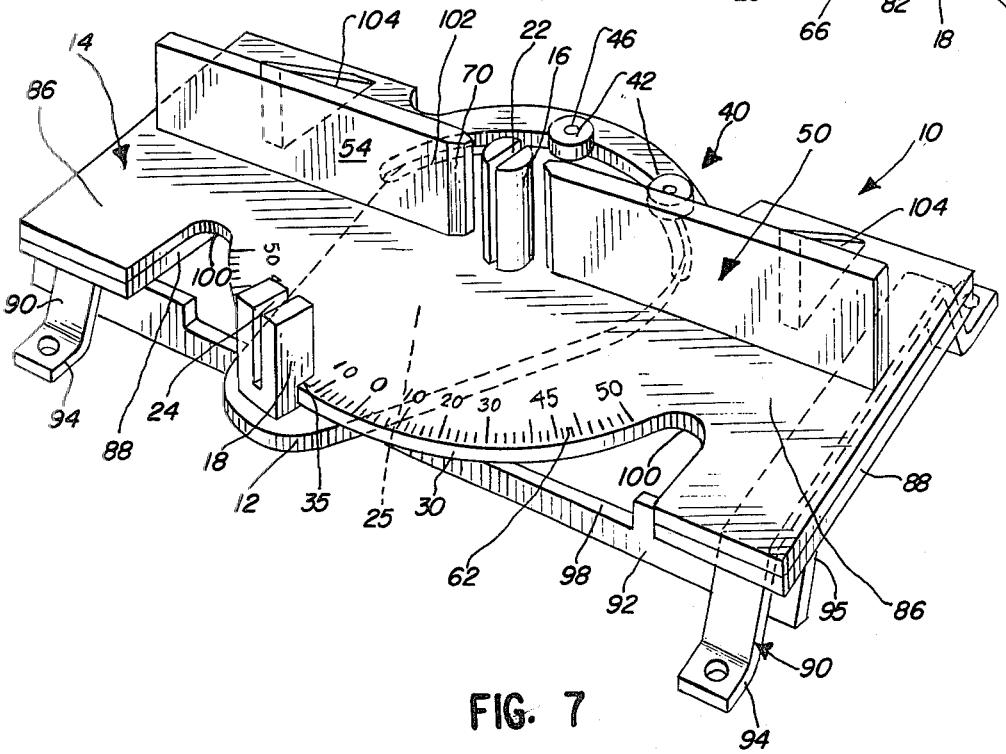
FIG. 7

MITER BOX

BACKGROUND OF THE INVENTION

1. Field of the Invention

This invention relates to a miter box and, more particularly, this invention relates to a portable miter box of simplified construction suitable for use with a common carpenter's saw.

2. Background of the Prior Art

Prior known miter boxes are of two types. The first type comprises a U-shaped box having a horizontal base and two upstanding parallel work supports. The work supports have vertical work support surfaces and precut saw guide slots disposed at fixed, commonly encountered angles with respect to the surfaces. Such a miter box may be used to cut only those angles defined by the fixed guide slots.

A second, continuously adjustable type of prior miter box utilizes rod-supported saw guides requiring special hanger-held roller-supported back saws or braced-back miter saws. Means for supporting such saws are required to allow two-hand positioning of a workpiece. Further, prior adjustable miter boxes generally allow positioning of a workpiece on only a single side of an upstanding work support.

Additionally, prior adjustable miter boxes are generally limited to cutting angles of between about 45° left to 45° right, due to the necessity of disposing each of a pair of radially spaced saw guide supports on opposite sides of a work support.

SUMMARY OF THE INVENTION

It is an object of the invention to overcome one or more of the problems described above.

According to the present invention, a simplified miter box suitable for use with a common carpenter's saw is provided. Special braced-back miter saws and back saws requiring roller guide supports are not required. Further, the miter box of the invention is portable and allows ready adjustment or replacement of workpieces and adjustment of cutting angles.

The miter box of the invention comprises a pair of relatively rotatable upper and lower platforms. A pair of radially spaced, upstanding saw guide posts, each having a vertical, upwardly open slot extending therethrough, are fixed to the lower platform. The first saw guide post has a portion of circular cross-section adjacent the lower platform complementary with and extending through a central hole in the upper platform, whereby the platforms are rotatable with respect to each other.

The upper platform has an outer circumferential edge, at least a portion of which is circular. The circular edge portion has an angular scale alignable with a reference mark on the lower platform.

The second saw guide post preferably has a circumferentially extending groove adjacent to and complementary with the lower platform circular edge to couple the upper and lower platforms for relative rotation.

Upstanding workpiece supporting means having at least one vertical face are fixed to and extend upwardly from the upper platform. Means are provided for selectively preventing relative rotation between the platforms.

Other objects and advantages will be apparent from the following detailed description taken in view of the drawings and the appended claims.

BRIEF DESCRIPTION OF THE DRAWINGS

FIG. 1 is a perspective view of a miter box made according to the invention, with a workpiece and saw shown in phantom line;

FIG. 2 is an exploded perspective view of the miter box of FIG. 1;

FIG. 3 is a perspective view of a modified embodiment of the central saw guide post of the miter box of FIGS. 1 and 2;

FIG. 4 is a perspective view of a modified embodiment of the outer saw guide post of the miter box of FIGS. 1 and 2;

FIG. 5 is another modified embodiment of the outer saw guide post of the miter box of FIGS. 1 and 2;

FIG. 6 is a fragmentary perspective view of a miter box as shown in FIGS. 1 and 2 with a modified form of outer saw guide post mounted on a temporary extension; and FIG. 7 is a perspective view of an alternative embodiment of the miter box of FIGS. 1 and 2.

DETAILED DESCRIPTION OF THE INVENTION

FIGS. 1 and 2 illustrate a miter box, generally designated 10, made according to the present invention. The miter box 10 comprises a pair of relatively rotatable lower and upper platforms 12 and 14, respectively.

Central and outer radially spaced upstanding saw guide posts 16 and 18, respectively, are fixed to the lower platform 12 as by pairs of wood screws 20 extending through holes 21 in the platform 12, for example, or by other suitable means. Each post 16, 18 has a respective vertical saw guide slot 22, 24, extending therethrough. Each slot 22, 24 opens upwardly at the upper end of its respective post 16, 18. The slots 22, 24 are radially aligned with each other. The posts 16 and 18 may be of any desired height in order to accommodate workpieces of widely varying heights.

The central post 16 of FIGS. 1 and 2 is a circular cylinder. The post 16 need not have a uniformly circular cross-section, but it must have at least a lowermost portion of circular cross-section adjacent the flat upper surface 25 of the lower platform 12. FIG. 3 illustrates one form of central post 16 having a lowermost cylindrical portion 26 of circular cross-section and an upper cylindrical portion 28 of generally ovoid cross-section. The saw guide slot 22 extends through the post portion 28 along its major axis.

When the post 16 of FIG. 3 is secured to the platform 12, the oval portion 28 is spaced from the platform 12 by a distance equal to the height of the circular portion 26, for reasons described below.

The upper platform 14 has a flat upper surface 29 and a circumferential outer edge 30 defining at least a portion of the circumference of a circle. A circular aperture 32 complementary with the center post 16 is disposed at the center of curvature of the circle defined by the edge 30. During assembly of the miter box 10, the center post 16 and upper platform 14 are positioned such that the post 16 is received through the aperture 32 to allow relative rotation between the platforms 12 and 14.

Of course, if the center post 16 is not of a uniformly circular cross-section, the aperture 32 receives the circular portion of the post, such as portion 26 in FIG. 3.

Thus, it is apparent that the height of the circular portion of the post 16 must be at least equal to the thickness of the upper platform 14 to allow free rotation between the platform 14 and the post 16.

Formed in the outer saw guide post 18 is an L-shaped, circumferentially extending, inwardly facing notch 34 of a height at least equal to the thickness of the upper platform 14. The notch 34 cooperates with the lower platform surface 25 to define a groove 35 which captures the circular outer edge 30 of the platform 14 for relative sliding movement of the platform 14 and post 18. The groove 35 also serves to retain the upper platform 14 in overlying relation to the lower platform 12.

FIGS. 4 and 5 illustrate modified embodiments of the outer saw guide post 18. The post of FIG. 4 is especially advantageous in that it provides increased radial length of the saw guide slot 24.

The lower platform 12 carries means, generally designated 40, for selectively preventing relative rotation between the platforms 12 and 14. As shown in FIGS. 1, 2 and 7, the rotation preventing means 40 comprises a pair of knobs 42 each having a central axial threaded through-bore 44 received on an upstanding screw 46 projecting upwardly from the platform 12. Threaded bores 48 in the platform 12 retain the screws 46. The knobs 42 are of a diameter sufficient to partially overly the upper platform 14 so as to firmly engage the platform 14 when tightened.

Upright workpiece supporting means, generally designated 50, are secured to the upper surface 29 of the platform 14. The supporting means 50 support a workpiece 52 against a support face 54 extending upwardly from the surface 29 at right angles thereto. The support means 50 of FIGS. 1 and 2 illustratively comprise a pair of radially opposed rectangular elements 56 each having parallel front and rear support faces 54 and 58. In FIGS. 1 and 2, the elements 56 are aligned with the cylindrical post 16, and the thickness 60 of each of the elements 56 is equal to the diameter of the post 16 such that the respective planes defined by aligned pairs of faces 54 and 58 each define a tangent to the circumferential surface of the post 16. Thus, a workpiece may be positioned on either side of the support 50.

However, it is not necessary that either aligned pair of faces 54 or 58 define a tangent with the outer surface of the post 16, but only that at least one such pair of faces does not intersect the post 16. If the planes of both pairs of aligned faces 54, 58 intersect the post 16, it is impossible to position a workpiece against the support means 50.

A pair of angular scales 62, 62' are inscribed on the platform surface 29 about the outer edge 30. The scales 62, 62' are alignable with a reference mark 63 inscribed on the platform and aligned with the slots 22 and 24. Since the scales 62, 62' are disposed about the circumference of the platform 14, it is possible to obtain relatively precise angular measurements.

A vernier scale 66 is inscribed on an inner surface 68 of the outer post 18 adjacent the groove 35 in order to accurately indicate fractional parts of division of the angular scales 62, 62'.

Each of the workpiece support elements 56 has a pair of opposed beveled edges 70 adjacent the center post 16 to accommodate a saw 72 extending through the slots 22, 24 at cutting angles greater than about 45°, measured with respect to the reference mark 64.

In operation, a workpiece 52 is placed on the platform surface 29 on either side of the support means 50, and the platform 14 is rotated to a desired cutting angle by aligning the appropriate scale 62, 62' with the reference mark 64. The knobs 42 are then tightened to secure the platforms 12 and 14 relative to each other, and the saw 72 is inserted into the slots 22 and 24. The saw 72 need not be a braced-back or supported saw, but may be a common carpenter's saw. Furthermore, the saw 72 is readily removed from the slots 22, 24 and replaced for repositioning of the workpiece 52.

In order to accommodate a relatively wide workpiece, the guide post 18 is removed and an extension plate 82 (FIG. 6) is temporarily secured to the platform 12 by screws 20 extending through the extension 82 into the holes 21 in the platform 12. The extension plate 82 extends radially outwardly from the platform 14 and carries an upstanding guide post 18 at its end 83 spaced from the platform 14. A vernier scale 66 is inscribed on a flat, horizontal upper surface 84 of the plate 82, which surface 84 lies in the plane defined by the platform surface 29.

In a miter box constructed as described above, the angular scale 62, 62' may extend from about 65° left to 65° right, or greater, depending on the width 60 of the support means 50.

The miter box 10 of the invention may be constructed of any convenient material, such as plywood or another readily available, economical construction material. The miter box 10 of FIGS. 1–6 is portable, and may be used on any convenient flat supporting surface. If desired, the lower platform 12 may be temporarily or permanently fixed to a supporting surface by means of screws or other means (not shown).

FIG. 7 illustrates an alternative embodiment of the miter box 10 of FIGS. 1–6 wherein the upper platform 14 is adapted to be fixed to an underlying supporting surface while the lower platform 12 is rotatable relative to the platform 14 and the supporting surface.

In the miter box 10 of FIG. 7, the upper platform 14 defines a circular edge 30 and further defines a pair of opposed transverse extensions 86. Secured to the underside of each extension 86 is a spacer block 88 which is at least as thick as the lower platform 12. Each spacer block 88 is secured to an appropriate support means, such as a support bracket 90 or a downwardly extending abutment stop 92.

The bracket 90 has downwardly extending legs 94 securable to an underlying supporting surface, while the abutment stop 92 projects downwardly from the spacer blocks 88, preferably at right angles thereto, to define a notch 95 which is engageable with a complementary edge of a supporting surface thus allowing the miter box 10 to be easily mounted on and removed from an edge of a work bench or other table-like structure. The abutment stop 92 is relieved as at 98 in order to accommodate the rotatable lower platform 12, and the upper platform 14 is relieved as at 100 to accommodate the post 18.

The lower platform 12 is supported by the groove 35 defined in the outer post 18, and by rotation preventing means 40 secured to platform 12 and overlying a circular edge 102 formed in the platform 14 opposite the edge section 30.

In the embodiment of FIG. 7, a workpiece (not shown) is positionable on only one side of the support means 50. If desired, additional support for the workpiece supporting means 50 may be provided, as by triangular braces 104 extending upwardly from the platform 14 and rearwardly from the supporting means 50.

The foregoing detailed description is given for clearness of understanding only, and no unnecessary limitations should be understood therefrom, as modifications will be obvious to those skilled in the art.

I claim:

1. A miter box, comprising:

(a) a lower platform;

(h) first and second radially spaced upstanding saw guide posts fixed to said lower platform with the region between said first and second guide posts being unobstructed above said lower platform, each said post having a vertical, upwardly open slot extending therethrough, said slots being in radial alignment, at least a portion of said first post adajcent said lower platform being of circular cross-section, said second post having a circumferentially extending groove formed therein, said groove comprising a generally L-shaped notch in said second post adjacent said lower platform and cooperating with said lower platform to form said groove, said groove facing said first saw guide post and capturing the circular edge portion of said upper platform for relative sliding movement of said edge portion relative to said second saw guide post;

(c) an upper platform overlying and coupled for relative rotation to said lower platform, said lower platform having at least a portion extending from beneath said upper platform, said second saw guide post secured to and extending upwardly from said extending portion, said upper platform having a flat upper surface and an outer circumferential edge, said outer edge defining at least a portion of a circle, said upper platform having a hole disposed at the center of curvature of said circle and receiving the circular portion of said first post for relative rotation of said first post and said upper platform, one of said lower and upper platforms being adapted to be fixed whereby said platforms are rotatable relative to each other;

(d) upright workpiece supporting means secured to said upper platform surface and extending radially outwardly from said hole, said workpiece supporting means having at least one flat vertical face, the plane of which resides between said first and second posts;

(e) a reference mark on said lower platform aligned with said slots;

(f) an angular scale on said upper platform surface adjacent said circular outer edge portion and alignable with said reference mark; and, (g) means for selectively preventing relative roation between said lower and upper platforms.

2. The miter box of claim 1 wherein said second saw guide post has a vernier scale inscribed thereon adjacent said groove and alignable with said angular scale.

3. The miter box of claim 3 wherein said workpiece supporting means comprises a pair of aligned upstanding members disposed on radially opposite sides of said first post, said post lying in a plane defined by said members.

4. The miter box of claim 3 wherein said members each define a pair of vertical, flat parallel faces, at least two of said faces being radially aligned to define a plane which defines a tangent to the surface of said first post.

5. The miter box of claim 4 wherein said first post comprises a circular cylinder and said members are each of a thickness equal to the diameter of said first post, and the respective faces of said opposed members define a pair of planes, each said plane defining a tangent to the circumferential surface of said first post.

6. The miter box of claim 5 wherein the ends of said members adjacent said first post have beveled vertical edges for accommodating a saw extending through said slots.

7. The miter box of claim 3 wherein said lower platform defines a flat, lower surface adapted to be supported by and at least temporarily fixed to an underlying surface whereby said upper platform is supported by said lower platform and is rotatable with respect to said lower platform and said supporting surface.

8. The miter box of claim 3 wherein said upper platform is adapted to be fixed to and supported by an underlying surface and one of said lower and upper platforms carries means engageable with the other of said platforms for supporting said lower platform.

9. The miter box of claim 8 wherein said means for supporting said lower platform comprise said groove in said second post in cooperation with said upper platform circular edge, and a second circular edge formed on one of said upper and lower platforms, and further means carried by the other of said upper and lower platforms for capturing said second circular edge.

10. The miter box of claim 8 wherein spacer means at least as thick as said lower platform are fixed to the underside of said upper platform, and a downwardly extending abutment stop is fixed to said spacer means to define a notch for engagement with a complementary edge of said underlying support surface.

* * * * *